US006023518A

United States Patent [19]

Kuwabara et al.

[11] Patent Number: 6,023,518

[45] Date of Patent: Feb. 8, 2000

[54] ELECTROMAGNETIC SOUND GENERATOR

[75] Inventors: Atsushi Kuwabara; Masato Asahina, both of Yamanashi-ken, Japan

[73] Assignee: Citizen Electronics Co., Ltd., Yamanashi, Japan

[21] Appl. No.: 09/293,804

[22] Filed: Apr. 19, 1999

[30] Foreign Application Priority Data

Apr. 24, 1998 [JP] Japan ..... 10-129683

[51] Int. Cl.[7] ..... H04R 25/00

[52] U.S. Cl. ..... 381/396; 381/431; 340/388.1; 340/825.46

[58] Field of Search ..... 340/388.4, 391.1, 340/388.1, 384.1, 311.1, 407.1, 825.44, 825.46; 381/396, 412, 431, FOR 152; 367/175

[56] References Cited

U.S. PATENT DOCUMENTS 4,944,017 7/1990 Cognasse et al. ..... 381/79
5,287,084 2/1994 Sone ..... 340/388.4

*Primary Examiner*—Sinh Tran
*Attorney, Agent, or Firm*—Dennison, Mererole, Scheiner & Schultz

[57] ABSTRACT

A case is formed by an upper case and a lower case, and a buzzer is provided in the case. Two coil springs are securely mounted in holes formed in the lower case. A lower portion of the coil spring is projected from an underside of the lower case. A pair of leads electrically connect both ends of the coil to the coil springs, respectively.

4 Claims, 4 Drawing Sheets

ELECTROMAGNETIC SOUND GENERATOR

BACKGROUND OF THE INVENTION

The present invention relates to an electromagnetic sound generator for generating sounds by vibrating a vibration plate by an electromagnet, and more particularly to an electromagnetic sound generator mounted on a printed circuit board by the surface mount technology.

In recent years, there is a tendency to mount small electric parts on a printed circuit board, the electromagnetic sound generator as a small buzzer is accordingly mounted on the printed circuit board. Such a printed circuit with the electromagnetic circuit board is used as a pager of the portable telephone and beeper.

Japanese Patent Application Laid Open 8-321670 discloses an electromagnetic sound generator.

FIG. 6 shows the electromagnetic sound generator. The electromagnetic sound generator 30 comprises a cylindrical case 31 in which a sound generating device is mounted and a pair of terminals 32. The terminals downwardly extend from the upper surface of the case 31. Each of the terminals is made of spring steel or stainless steel, and has elasticity consequently. A lower end portion 33 is bent in a V-shape. On the corner of the bent portion formed is a projection 34 which is soldered to a wiring pattern on a printed circuit board.

FIG. 7 shows another conventional electromagnetic sound generator. The sound generator 40 comprises a cylindrical case 41 and a pair of terminals 42 secured to the upper surface of the case 41. Each of the terminal is extended in a radial direction and bent in a V-shape. A projection 43 is formed on the upper side of the terminal to be soldered to a wiring pattern on a printed circuit board.

These conventional prior arts have disadvantages that terminals must be connected with the printed circuit by soldering one by one, which is very troublesome work and increases the manufacturing cost. Since the terminal projects from the device, a large space is occupied by the device.

SUMMARY OF THE INVENTION

An object of the present invention is to provide an electromagnetic sound generator which can be made into a small size and terminals can be easily and accurately connected to a printed circuit, the manufacturing is consequently reduced.

According to the present invention, there is provided an electromagnetic sound generator comprising, a case formed by an upper case and a lower case, a buzzer provided in the case, the buzzer comprising a yoke, a magnet, a vibrating plate and a coil, at least two coil springs each of which is securely mounted in a hole formed in the lower case, and a lower portion of the coil spring being projected from an underside of the lower case, and a pair of leads electrically connecting both ends of the coil to the coil springs, respectively.

The connecting portions between the both ends of the coil and the leads are coated with silicon.

The lead comprises an elongated metal plate which is embedded in the lower case and an upper end of the coil spring is inserted in a hole formed in the metal plate and soldered to the metal plate.

These and other objects and features of the present invention will become more apparent from the following detailed description with reference to the accompanying drawings.

DETAILED DESCRIPTION OF THE PREFERRED EMBODIMENT

Figure 1:
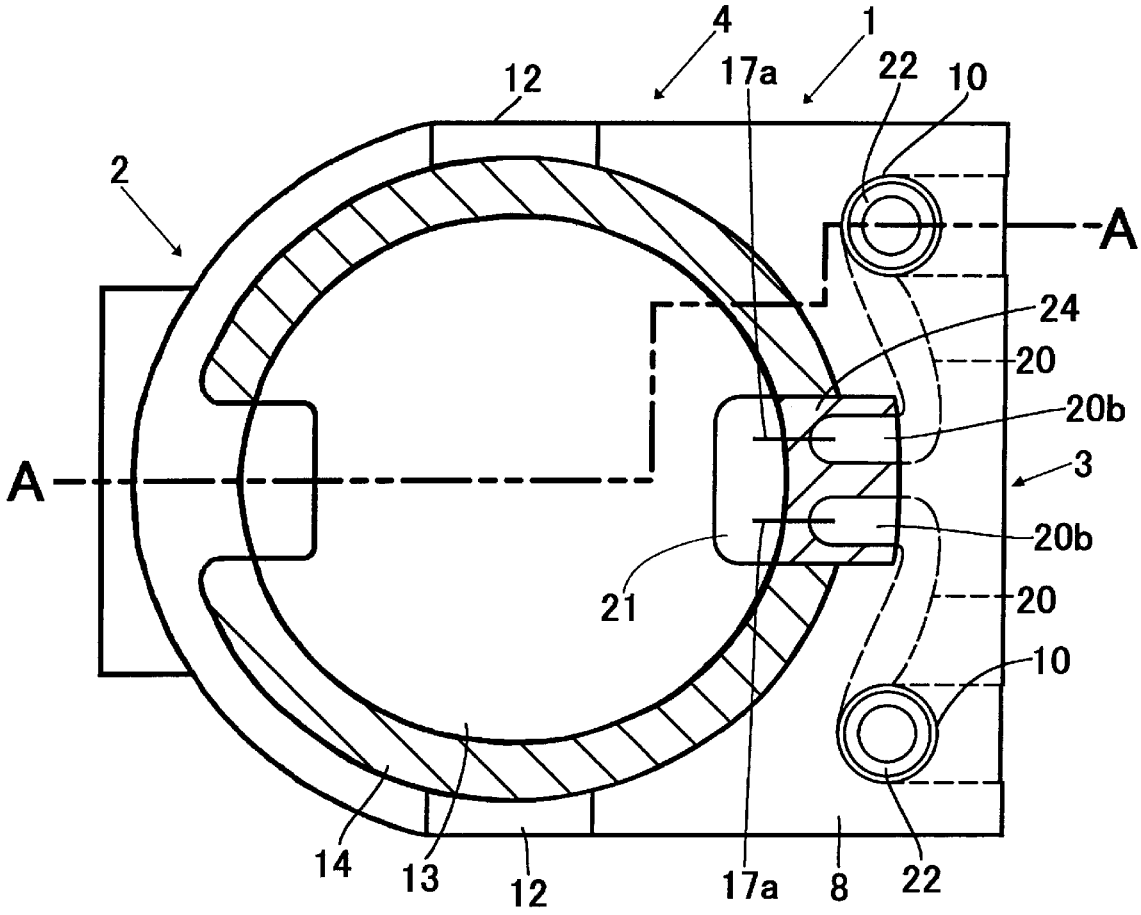
FIG. 1 is a plan view showing the underside of an electromagnetic sound generator according to the present invention.
Figure 2:
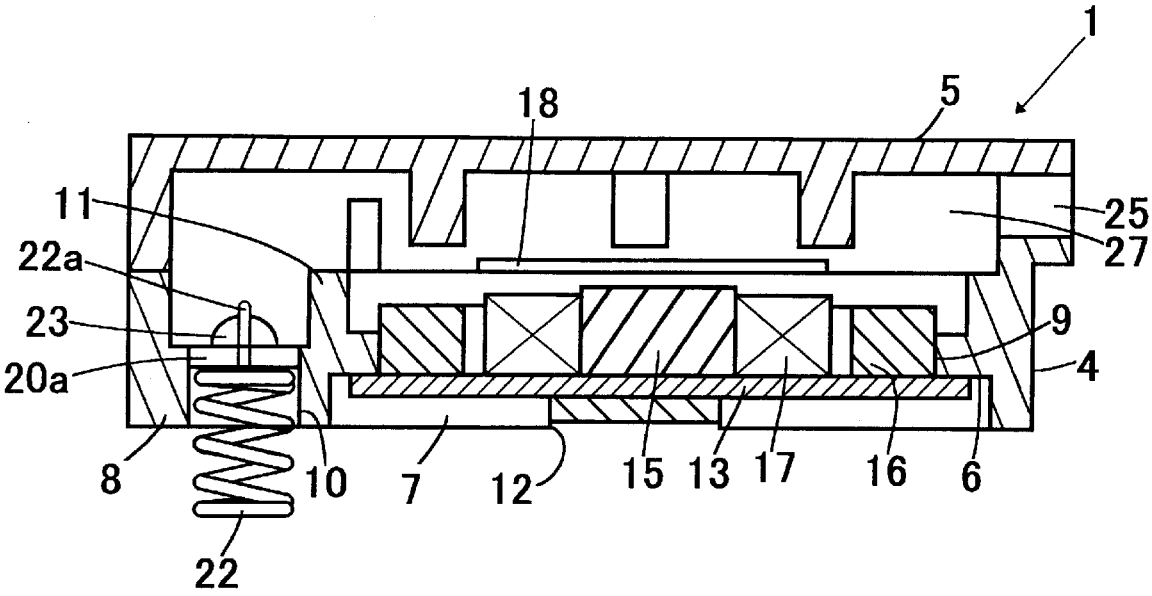
FIG. 2 is a sectional view taken along a line A—A of FIG. 1.
Figure 3:
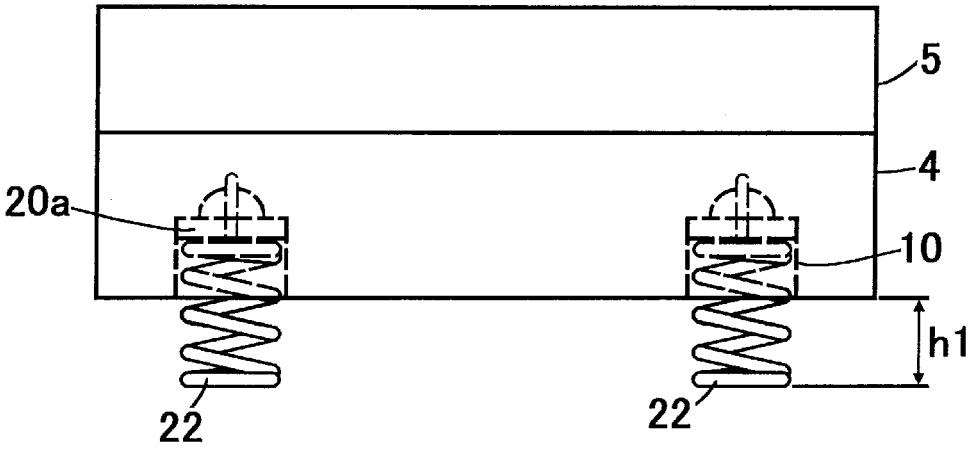
FIG. 3 is a side view of the sound generator as viewed from the right side of FIG. 1.

Referring to FIGS. 1 and 2, a case 1 of the electromagnetic sound generator comprises a circular portion 2 and an angular portion 3, and a lower case 4 and an upper case 5.

The lower case 4 has an indented bottom 6 to form a recess 7, and a cubic portion 8. A circular hole 9 is formed in the bottom 6, and a pair of cylindrical holes 10 are formed in the cubic portion 8. The axis of the hole 10 is parallel to the axis of the circular hole 9. There is formed an annular wall 11 opposite the recess 7, and an air escaping hole 12 is formed in the wall 11.

A yoke 13 made of magnetic material is secured to the underside of the bottom 6 by epoxy resin 14. A core 15 is secured to the surface of the yoke 13. An annular magnet 16 and a coil 17 are mounted on the yoke 13. An annular vibrating plate 18 is secured on the annular wall 11. Thus, a magnetic circuit for a buzzer is formed by the yoke 13, core 15, magnet 16, and vibrating plate 18.

A pair of lead plates 20, each of which is made of an elongated metal plate, are embedded in the lower case 4. Each of the lead plates 20 is extended between the upper end of the hole 10 and the underside of the lower case 4 at a notch 21 of the yoke 13. A coil spring 22 is inserted in each hole 10. An upper end 22*a* of the coil spring 22 is inserted in a hole formed in an end portion 20*a* of the lead plate 20 and electrically connected to the lead plate 20 by solder 23. The lower end of the spring is projected from the underside of the lower case 4 by a height h1.

Both ends 17*a* of the coil 17 are soldered to ends 20*b* of lead plates 20 and covered by silicon coating 24. Thus, the coil 17 is connected to the coil springs 22.

The upper case 5 has a sound emanating hole 25. The upper case 5 is adhered to the lower case 4 so that a resonance room 27 is formed in the case 1.

Figure 4:
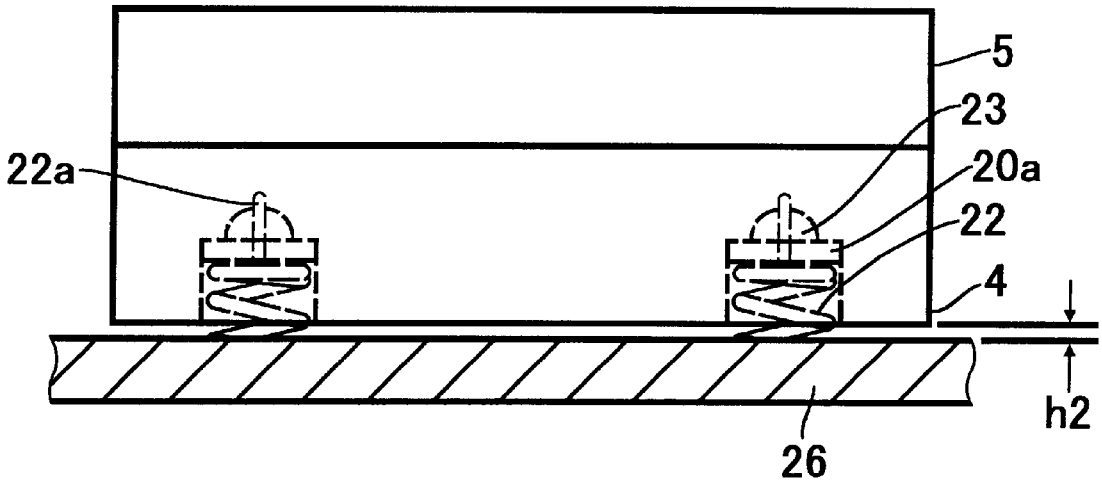
FIG. 4 is a side view of the sound generator mounted on a printed circuit board.

FIG. 4 shows the condition where the sound generator is mounted in a portable telephone. A printed circuit board 26 of the sound generator is secured to one of cases of the portable telephone. The other cases are secured to the former case, so that the coil springs 22 are pressed against printed circuits on the circuit board 26. Thus, the coil 17 is electrically connected to the circuit. There is formed a gap of a height h2. When the vibrating plate 18 is vibrated by exciting the coil 17, sound is emanated from the sound emanating hole 25. The gap of the height h2 prevents the vibration of the case 1 from transmitting to the circuit board 26, which causes noises.

Figure 5:
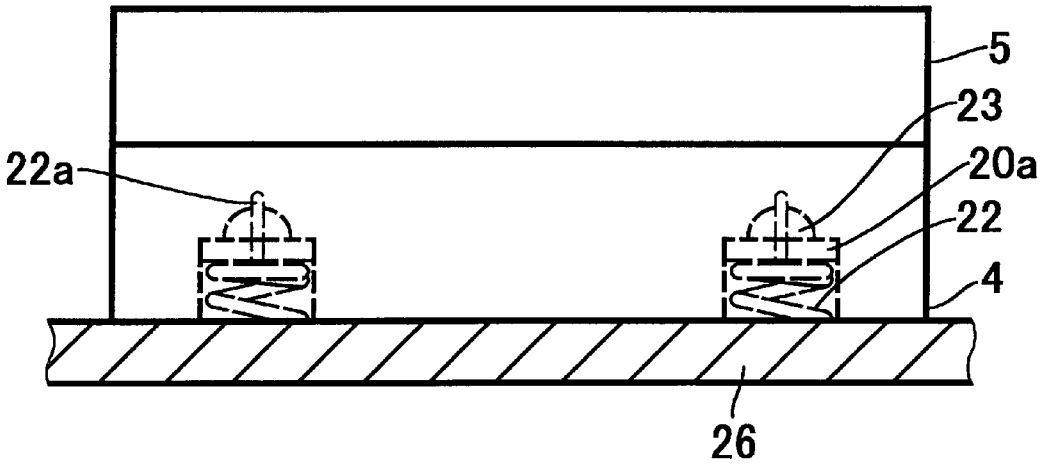
FIG. 5 is a side view of the sound generator mounted on a printed circuit board by a different manner from FIG. 4.
Figure 6:
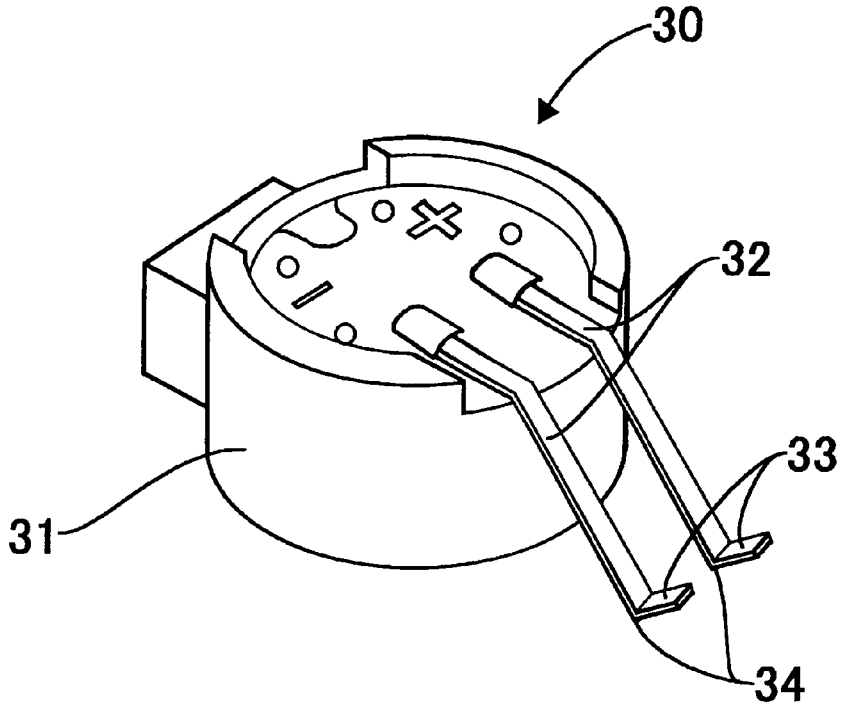
FIG. 6 PRIOR ART
FIGS. 6 and 7 are perspective views of conventional electromagnetic sound generators.
Figure 7:
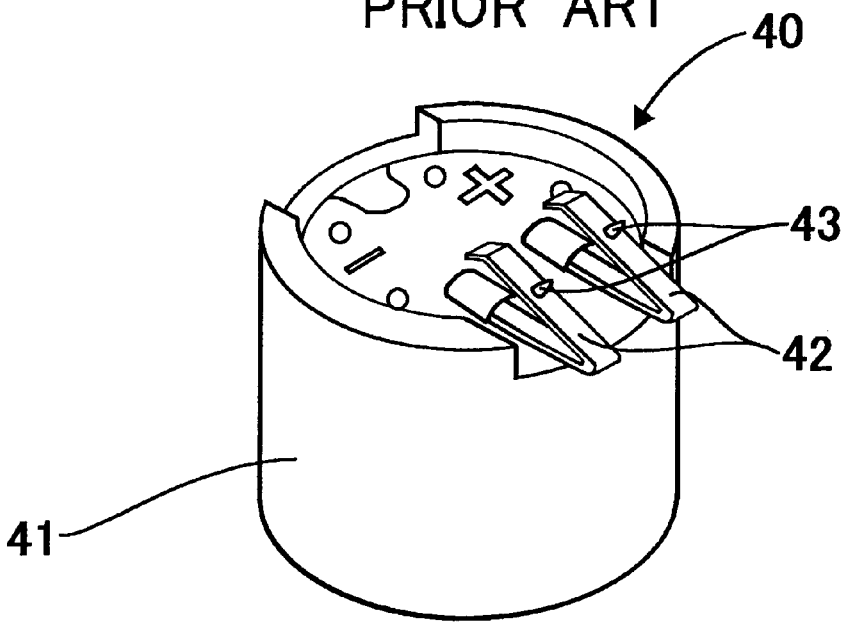
FIG. 7 PRIOR ART

FIG. 5 shows the condition where the gap is zero.

In accordance with the present invention, terminals do not laterally project from the case. Therefore, the sound generator does not occupy a large space. Since the terminals formed by the coil springs are not soldered to the printed circuit of the printed circuit board, the workability of the assembling of the sound generator is much increased, and accordingly reducing the manufacturing cost.

While the invention has been described in conjunction with preferred specific embodiment thereof, it will be understood that this description is intended to illustrate and not limit the scope of the invention, which is defined by the following claims.

What is claimed is:

1. An electromagnetic sound generator comprising:

a case formed by an upper case and a lower case;

a buzzer provided in the case, the buzzer comprising a yoke, a magnet, a vibrating plate and a coil;

at least two coil springs each of which is securely mounted in a hole formed in the lower case, and a lower portion of the coil spring being projected from an underside of the lower case; and a pair of leads electrically connecting both ends of the coil to the coil springs, respectively.

2. The sound generator according to claim 1 wherein both ends of the coil and the leads are connected by a solder, and the connected portion is coated with silicon.

3. The sound generator according to claim 1 wherein the lead comprises an elongated metal plate which is embedded in the lower case, except a connecting portion to the coil and a connecting portion to the coil spring.

4. The sound generator according to claim 3 wherein an upper end of the coil spring is inserted in a hole formed in the metal plate and soldered to the metal plate.

* * * * *